United States Patent [19]

Pham Van

[11] 4,263,490

[45] Apr. 21, 1981

[54] DEVICE FOR SWITCHING IN CLOSING RESISTORS FOR HIGH-VOLTAGE CUT-OUT SWITCHES

[75] Inventor: Doan Pham Van, Meyzieu, France

[73] Assignee: Delle-Alsthom, Villeurbanne, France

[21] Appl. No.: 932,970

[22] Filed: Aug. 11, 1978

[30] Foreign Application Priority Data

Aug. 24, 1977 [FR] France ..... 77 25777

[51] Int. Cl.[3] ..... H01H 33/16

[52] U.S. Cl. ..... 200/144 AP; 200/148 R

[58] Field of Search ..... 200/144 AP, 145, 148 R, 200/148 A, 148 F

[56] References Cited

U.S. PATENT DOCUMENTS

| | | | |
|---|---|---|---|
| 3,291,947 | 12/1966 | Van Sickle | 200/144 AP |
| 3,676,621 | 7/1972 | Pflanz | 200/144 AP |
| 4,009,458 | 2/1977 | Kishi et al. | 200/144 AP X |

FOREIGN PATENT DOCUMENTS

| | | |
|---|---|---|
| 1302499 | 7/1962 | France . |
| 430452 | 6/1935 | United Kingdom . |
| 724707 | 2/1955 | United Kingdom . |

*Primary Examiner*—James R. Scott

*Attorney, Agent, or Firm*—Sughrue, Rothwell, Mion, Zinn and Macpeak

[57] ABSTRACT

A reciprocating rod bears a bridge which is movable on the rod with initial movement of the rod in a given direction completing closure of bridge carried moving contacts onto stationary contacts for inserting a resistance in a circuit during closure. Linkage between the rod and main contacts functions to subsequently close the main contacts of the cut-out switch, thereby shorting the resistor. Continued movement of the rod in a given direction subsequently causes the bridge borne contacts to move away from the stationary contacts, thereby opening the circuit through the resistors.

12 Claims, 9 Drawing Figures

DEVICE FOR SWITCHING IN CLOSING RESISTORS FOR HIGH-VOLTAGE CUT-OUT SWITCHES

FIELD OF THE INVENTION

The invention relates to a device for switching in closing resistors of high-voltage cut-out switches which are intended to limit overvoltages when long unloaded lines are closed simply or in a rapid reconnection cycle. Such cut-out switches are very often equipped with closing resistors which are switched in the circuit between the source and the line for about ten milliseconds before the main contacts are closed.

BACKGROUND OF THE INVENTION

The disposition currently used consists of connecting an auxiliary closing chamber in parallel with the main chamber of the cut-out switch; this auxiliary closing chamber is constituted by an insulative casing which is generally made of ceramics such as porcelain and contains firstly a resistor which has a stationary contact at one of its ends and secondly a movable contact which is actuated by a countershaft mechanism controlled by the switch bar of the contacts of the main cut-out chambers. This mechanism then closes this moving contact a few milliseconds before the main chamber and opens it before the contacts of the main chamber part, since the auxiliary closing chamber is assumed not to have any circuit breaking capability.

Such a device with its rather complex mechanism is not very cheap.

Indeed, to obtain high dielectric strength in the opening position the contacts of the resistor should normally be in the middle of the casing which contains the resistor; this leaves only half the casing for the resistor and leads to inefficient use of the space provided by this casing.

Further, in the majority of cases, one resistor and one pair of contacts are necessary per main chamber, one of the contacts being a stationary contact and the other being a moving contact.

Lastly, in the case where two resistor stages are used successively, i.e. where a first resistor is firstly switched in, then a second resistor with a lower resistance before the main chamber closes, the countershaft mechanism becomes more complex and the extra energy required from the switching unit is greater.

The invention aims to produce a closing device for a high-voltage cut-out switch which uses the insulative casings of the auxiliary chambers more efficiently by reducing their volume, as well as to simplify the production and operation thereof and in the case where there are two stages of resistors, to reduce the number of resistors per phase.

SUMMARY OF THE INVENTION

The invention provides a device for switching in closing resistors for a high-voltage cut-out switch, said device including at least two cut-out chambers disposed in series, characterized in that the closing resistors are each disposed in auxiliary insulative chambers and that the stationary contacts for connecting them in series, as well as the moving bridge, are disposed in an intermediate chamber and the auxiliary chambers can be placed in prolongation of each other.

According to another characteristic, the switching in device is actuated directly by the switch bar of the contacts of the cut-out chambers of the cut-out switch and it is placed at the end of the switch bar.

According to another characteristic, the device includes a moving bridge which connects the stationary contacts for connecting in series the two closing resistors; said resistors being disposed at the terminals of the two cut-out chambers.

According to another characteristic each auxiliary chamber is separated from the intermediate chamber by an insulative cone through the apex of which the end of the closing resistor passes, thus connecting the latter to the stationary contact for connecting them in series and the dielectric fluid of the intermediate chamber may be different from that of the auxiliary chambers.

According to another embodiment, the intermediate chamber and the auxiliary chambers may inter-communicate via an orifice which is disposed in the axis of the insulative cone and which is provided with a filter.

According to one disposition, the opening distance between the contacts of the auxiliary chambers is shorter than that between the contacts of the cut-out chambers.

The means for actuating the moving bridge by the switch bar may include firstly a stud with a spring and secondly a cam with at least one stop. In one variant, the means for actuating the moving bridge by the switch bar may include an over-center compression spring which passes to a neutral point.

The characteristics and advantages of the invention will become apparent from the following description given with reference to one embodiment which is shown by way of illustration in the drawings.

DESCRIPTION OF PREFERRED EMBODIMENTS

Figure 1:
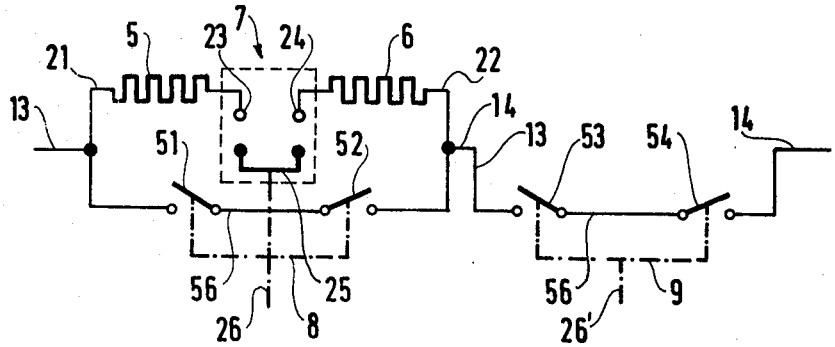
FIG. 1 is a circuit diagram which corresponds to a switching in device in accordance with the invention.
Figure 2:
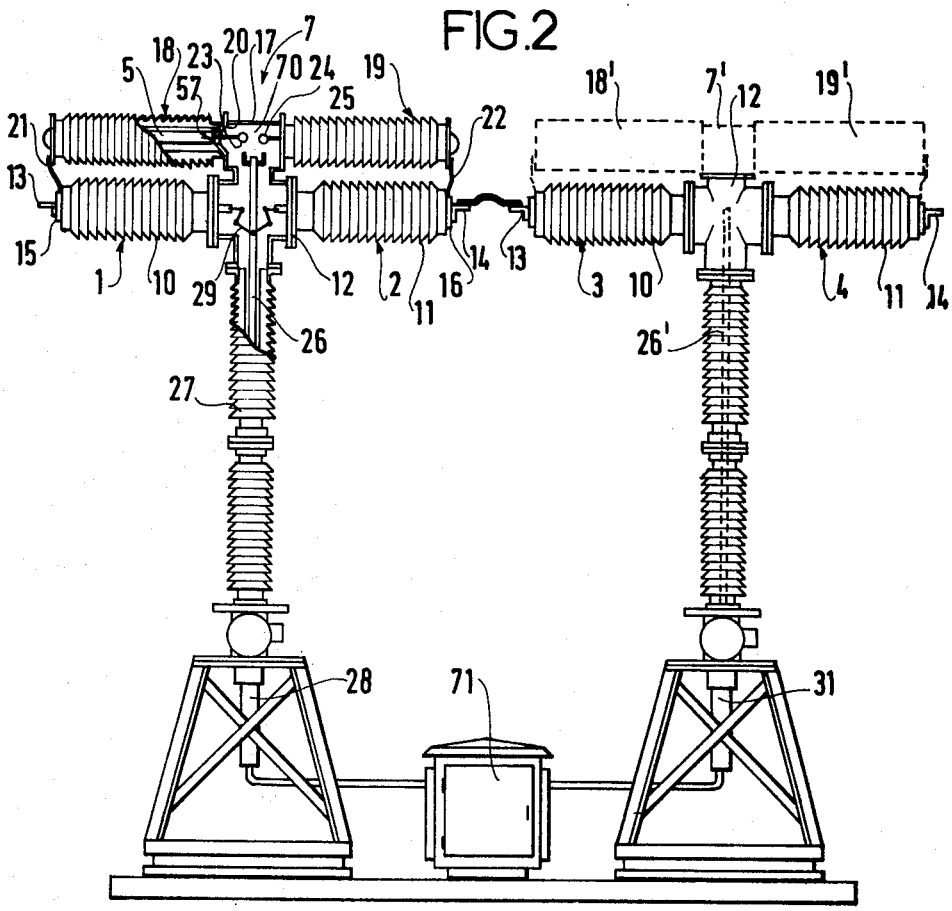
FIG. 2 is a schematic, partial cross-sectional view of a cut-out switch in accordance with the invention.

The circuit diagram of FIG. 1 correponds to the closing device of the cut-out switch in FIG. 2 which switch includes four main cut-out chambers 1, 2, 3 and 4 whose cut-out contacts 51, 52, 53 and 54 are disposed in series between the terminals 13 and 14, and a device 7 for switching in two closing resistors 5 and 6. The switching in device 7 includes a moving bridge 25 placed directly at the end of the insulation rod 26 which controls the cut-out contacts 51 and 52 by means of an insulative mechanical link 8. Similarly, an insulative mechanical link 9 transmits the movement of an insulative rod 26' to the other two cut-out contacts 53 and 54.

The switching in device 7 further includes two stationary contacts 23 and 24 for connecting the closing resistors 5 and 6 by means of the moving bridge; this resistor assembly is connected in parallel with the assembly of cut-out contacts 51 and 52 which are themselves connected in series by means of a connection 56. The ends of the resistor assembly are connected to corresponding ends of the circuit-breaking contacts 51 and 52 via respective connections 21 and 22.

The main cut-out chambers 1, 2, 3 and 4 shown in FIG. 2 are not shown in detail, since they are of a conventional type. They include insulative casings 10 and 11 filled with a dielectric fluid such as sulphur hexafluoride.

The chambers 1 and 2 and the chambers 18 and 19 are connected in pairs to each other by a housing 12 which contains a link mechanism 29 between the cut-out contacts 51 and 52 and the insulative switch bar 26, as well as the connection 56 between the cut-out chambers. The ends of these pairs of chambers are closed by covers 15 and 16 on which terminals 13 and 14 connected to the cut-out contacts are fixed.

A housing 12 is fixed on an insulative support 27 which is filled with sulphur hexafluoride and through which pass the switch bars 26 and 26' which are controlled by actuators constituted by jacks 28 and 31 which are actuated by a storage battery 71.

A casing 17 which may be made of metal is placed above the housing 12. The casing constitutes an intermediate chamber 70 which contains the switching in device 7. The chamber 70 houses the moving bridge 25 and the two stationary contacts 23 and 24, at one end of the switch bar 26. Two insulative auxiliary chambers 18 and 19 are fixed on the sides of the casing 17. These chambers contain respectively the closing resistor 5 between the contact 23 and the connection 21 and the closing resistor 6 between the contact 24 and the connection 22. The ends of the insulative chambers 18 and 19 are closed by covers which act as supports for the resistors and for the connections 21 and 22 connected to the covers 15 and 16 of the main chambers 1 and 2.

An insulative cone 20 is fixed on each side of the casing 17 between the intermediate chamber 70 and the end of each auxiliary chamber 18, 19, said chambers being disposed facing each other and in line with each other.

The stationary contacts 23 and 24 of the switching in device are preferably spherical so as to generate a homogeneous electric field inside the casing 17. As in FIG. 3, they may comprise fingers 35 which are housed inside the stationary contacts 23 and 24 and co-operate with rods 36 which are installed on the contact bridge 25 and are protected against electric discharge by curved hoods 37 fixed on the casing 17.

The switching units and the connections are such that when the cut-out switch closes, the cut-out contacts 53, 54 of the chambers 3 and 4 close firstly simultaneously, like the moving bridge 25; this switches in the closing resistors 5 and 6 in the circuit (not shown) controlled by the cut-out switch; then, after about 10 milliseconds, the cut-out contacts 51 and 52 also close, shunting the closing resistors 5 and 6. Then, the switching in device can either open a few instants after, to throw the closing resistors out of circuit or remain closed, but open a few instants before the cut-out contacts 51 and 52, while the cut-out switch opens.

Figure 3:
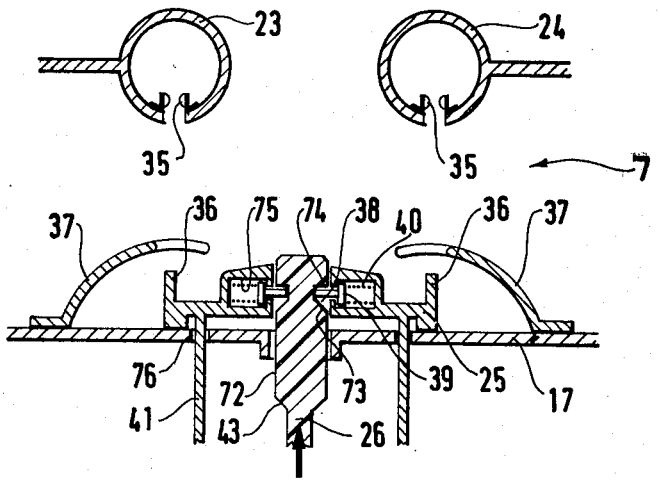
FIG. 3 is a partial cross-sectional view of the switching in device in the open position of the cut-out switch.

The switching in device shown in FIG. 3 corresponds to the first solution. For this purpose, the end of the switch bar has a cylindrical cam 72 delimited by a lower sloping portion 43 and an upper sloping portion 73 which leads into a constriction 38 which defines an integral upper stop 74. The moving bridge 25 comprises firstly, in its central portion, a bore 75 slideable over the cam 72 and secondly, on its lower periphery, two guide rods 41 slideable through holes 76 in the bottom of the casing 17. The bore 75 is provided with studs 39 which are actuated by springs 40 and which may co-operate with the end of the switch bar 26.

The device then operates as follows. When the cut-out switch closes, a first order is sent to the jack 31 which transmits its movement to the switch bar 26' which closes the contacts 53 and 54 of the chambers 3 and 4. Then, after a delay t, a second order is sent to the jack 28 which transmits its movement firstly to the switch bar 26 which directly controls the moving bridge 25 and secondly to the contacts 51 and 52 of the chambers 1 and 2 via conventional closing mechanisms 29.

Indeed, the studs 29 which engage in the constriction 38 immediately drive the moving bridge 25 until it abuts against the stationary contacts 23 and 24 after the rods 36 have come into contact with the fingers 35.

Figure 4:
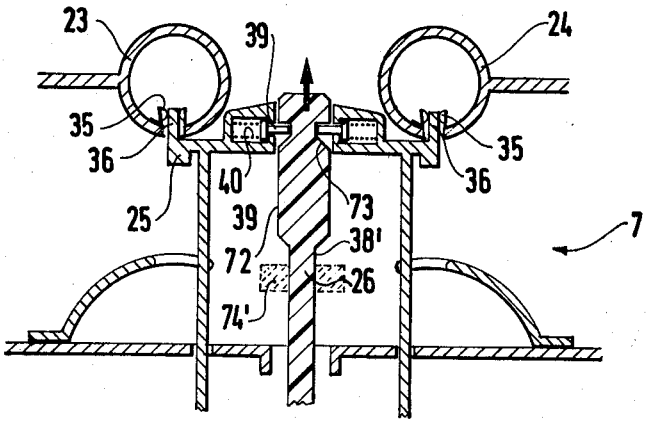
FIG. 4 is a cross-sectional view of the switching in device in accordance with FIG. 3 when the cut-out switch closes.

The delay is such that the contacts 53 and 54 close concurrently with the contacts 35 and 36; this brings the closing resistors 5 and 6 into service, as in the position shown in FIG. 4.

Figure 5:
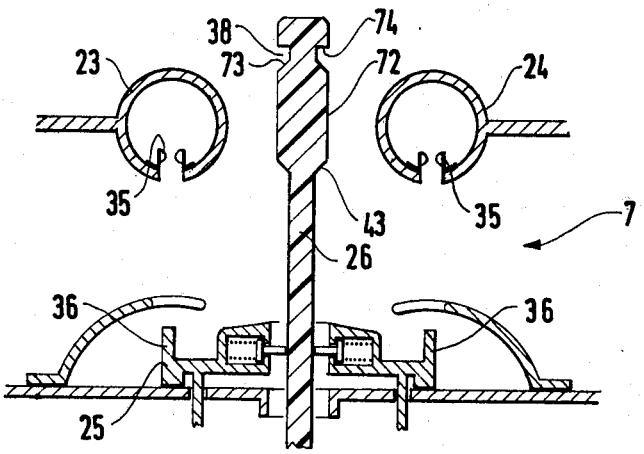
FIG. 5 is a cross-sectional view of the switching in device in accordance with FIG. 3 after the cut-out switch has closed.

Then the contacts 51 and 52 close and thus shunt the closing resistors 5 and 6, while the switch bar 26 continues its upward movement. During this movement, the studs 39 slide on the sloping portion 73, and then slide on the cam 72 and the sloping portion 43; this releases the moving bridge 25 which falls away under the effect of its own weight. The position is then that shown in FIG. 5.

The preceding sequence is obtained firstly by the above-mentioned time delay t between operation of the jacks 31 and 28 and by the length of the cam 72 between the sloping portions 43 and 73 and secondly by an opening distance between the stationary contacts 23 and 24 with the contact rods 36 of the moving bridge 25 shorter than the opening distance of the contacts of the main cut-out chambers 1, 2, 3 and 4; this can very well be obtained with cut-out switches in which arcs are automatically quenched in sulphur hexafluoride or even in oil.

When the cut-out switch is opened, the starting order is sent simultaneously to both of the jacks and the contacts of the main chambers 1, 2, 3 and 4 part at the same time, in a known manner.

In a variant of the device in accordance with FIG. 3, the switch bar 26 can have, as shown in broken lines in FIG. 4, a constriction 38' adjacent to the sloping portion 43; this constriction is symmetrical to the constriction 38, i.e. limited by a stop 74'. In this case, at the end of the closing movement of the switch bar 26, the studs 39 engage in the lower constriction 38' the stop 74; this keeps the contacts of the resistors 5 and 6 closed. When the switch bar 26 opens, it immediately clears the contacts 35 and 36, thus taking the resistors 5 and 6 out of circuit before the contacts of the main chambers 1 to 4 part.

Figure 6:
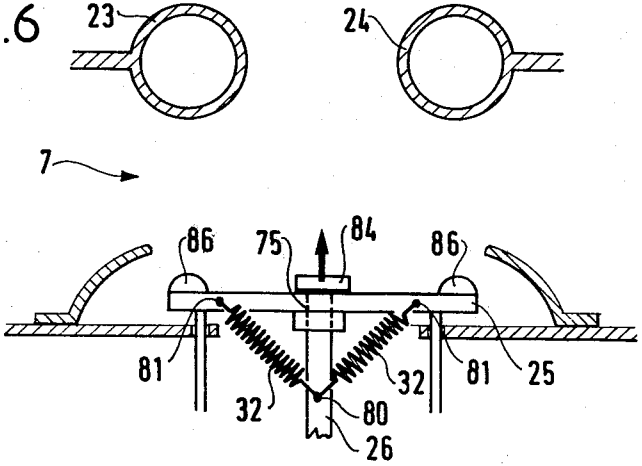
FIG. 6 is a partial cross-sectional view of an embodiment of the switching in device in the open position of the cut-out switch.

In the embodiment of FIG. 6, the contacts 23 and 24 are spheres against which abut the contact pieces 86 which are disposed at the periphery of the moving bridge 25. The switch bar 26 has a lower stop 44 and an upper stop 84 between which the bore 75 of the moving bridge 25 slides.

For this purpose, compression springs 32 are installed between a central pin 80 and disposed on the rod 26 between the stops 44 and 84 and an eccentric pin 81 and are disposed on the moving bridge 25.

Figure 7:
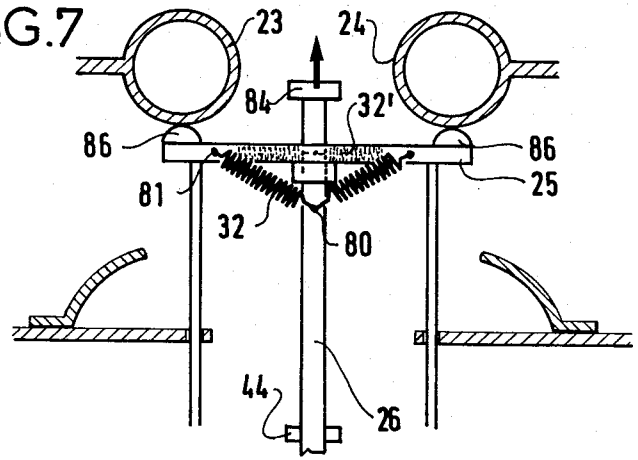
FIG. 7 is a cross-sectional view of the device in accordance with FIG. 6 when the cut-out switch closes.

When the cut-out switch closes, the moving bridge 25 is drawn upwards by the switch bar 26 by means of the compression spring 32 until the moving bridge 25 is closed, as shown in FIG. 7.

In this position, the moving bridge 25 abuts against the stationary contacts 23 and 24, but the switch bar 26 continues its upward stroke, compressing the spring 32 until the direction of the articulation pins 80 and 81 are perpendicular to the direction of the switch bar 26; this position is shown in broken lines at 32' in FIG. 7 and constitutes a neutral point and defining an over-center spring mechanism.

Figure 8:
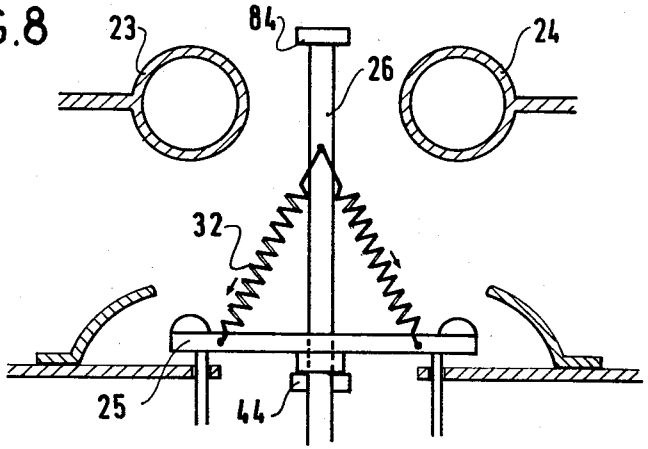
FIG. 8 is a cross-sectional view of the device in accordance with FIG. 6 after the cut-out switch has closed.

From this neutral point, the relative position of the two pins 80 and 81 is reversed; this opens the moving bridge 25, while the switch bar 26 completes its stroke in the position shown in FIG. 8.

Thus, the closing resistor switching in device, which is in a cylindrical or spherical metal casing, has small bulk in relation to the insulative casings of the auxiliary chambers which contain the resistors. The resistors can then occupy the whole length of the casing. Thus, the available space is more efficiently used.

The metal casing 17 can be separated completely by an insulative cone 20 from the volume of an insulative casing which contains a resistor, so that different gases or liquids may be used in the two casings. For example, sulphur hexafluoride may be used in the metal casing and oil may be used in the insulative casing.

In the casing where the insulative and metal casings are filled with the same gas at the same pressure, for example, sulphur hexafluoride at 3 bars, the various casings can be in communication with each other. However, the decomposition products of sulphur hexafluoride which is decomposed by the closing arc or by the cut-out arc of the main chamber are prevented from entering the resistor casing by providing a filter 57 in the communication orifice in the axis of the cone 20.

In the case where the overvoltage levels are to be further reduced by means of a three-stage closing device which inserts resistors of different values, the main chambers 3 and 4 are provided with additional auxiliary chambers 18' and 19' which are similar to those which equip the main chambers 1 and 2 shown in broken lines in FIG. 2 and with an extra device 71. But then the opening distance between the stationary contacts and the moving bridge of the auxiliary chambers 18' and 19' will be longer than that between the stationary contacts and the moving bridge of the auxiliary chambers 18 and 19.

Figure 9:
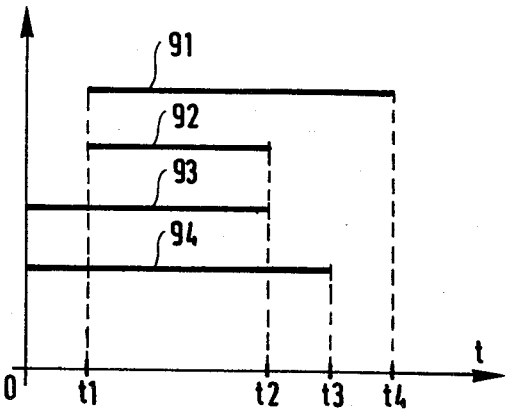
FIG. 9 is a timing diagram of the movement of the contacts in a three-phase cut-out device.

Thus the diagram of FIG. 9 corresponds to the movement of contacts which include such a three-stage closing device and the movements of the various contacts are plotted along the y axis and the phases are plotted along the x axis.

In this diagram:

the movements of the conacts 51 and 52 of the main chambers 1 and 2 start at the instant $t_1$ and end at the instant $t_4$, as shown at 91;

the movements of the contacts 23 and 24 of the auxiliary chambers 18 and 19 start at the instant $t_1$ and end at the instant $t_2$, as shown at 92;

the movements of the contacts of the auxiliary chambers 18' and 19' start at the instant 0 and end at the instant $t_2$, as shown at 93;

the movements of the contacts of the auxiliary chambers 3 and 4 start at the instant 0 and end at the instant $t_3$, as shown at 94; and the interval between the orders to the two jacks 28 and 31 corresponds to $t_1$.

But both these jacks could just as well be replaced by a single jack, the mechanisms then being driven by means such as connecting rods with ports, countershafts, etc. so that the interval is equivalent to $t_1$ (or t).

Thus, the orders are such that:

the contacts of the moving bridges are closed simultaneously at $t_2$ and the four resistors are thus connected in series;

the contacts of the chambers 3 and 4 are closed at $t_3$, i.e. about 10 milliseconds after $t_2$ thus shunting the resistors of the auxiliary chambers 18' and 19'; and the contacts of the main chambers 1 and 2 are closed at $t_4$, i.e. about 10 milliseconds after $t_3$ thus shunting the resistors of the auxiliary chambers 18 and 19.

The auxiliary chambers which are associated in pairs can be disposed either horizontally in line with each other, as in FIG. 2, or in a V or inverted V configuration to account for the electric field.

They can be placed either in the same vertical plane of the main chambers and above these chambers, or in a vertical plane which forms an acute angle with the vertical plane of the main chambers.

It is obvious that the invention is in no way limited to the embodiments which have just been described and illustrated and which have been given only by way of examples; in particular, without going beyond the scope of the invention, some dispositions can be changed or some means can be replaced by equivalent means or some components can be replaced by others which are capable of fulfilling the same technical function or an equivalent technical function.

I claim:

1. A high-voltage cut-out switch for opening and closing a circuit, said cut-out switch comprising:

at least two series disposed main chambers housing separable fixed and movable main contacts, a rod mounted for reciprocation and interposed between said main chambers, auxiliary insulative chambers extending parallel to said at least two series disposed main chambers on opposite isdes of the path of movement of said rod, a closing resistor in each of said auxiliary chambers, stationary contacts connected to said closing resistors, a moving bridge carried by said rod and bearing moving contacts for bridging said stationary contacts to connect said resistors in series and for shunting said resistors across said main contacts, and means for connecting said resistors in series and shunted across the main contacts prior to closure of the main contacts and for keeping the resistors out of the circuit during opening of said main contacts, the improvement comprising:

a linkage connecting said rod to said moving main contacts to effect closing and opening of said main contacts, an intermediate chamber positioned intermediate of said auxiliary insulative chambers, said intermediate chamber bearing said stationary contacts for connecting the closing resistors in series, said moving bridge being disposed within said intermediate chamber and being mounted to said rod for movement independent of said rod, and means for effecting initial movement of said rod in a given direction for effecting closure of said bridge carried moving contacts onto said stationary contacts for inserting the resistance in the circuit during closure and for operating said linkage to subsequently close said main contacts to short said resistors and for moving said bridge away from said stationary contacts during continued movement of said rod in said given direction.

2. A high voltage cut-out switch as claimed in claim 1, wherein said switch further comprises means for selectively latching said moving bridge to the end of said rod.

3. A high voltage cut-out switch according to claim 1, wherein said resistors are connected to said stationary contacts disposed in said intermediate chamber.

4. A high voltage cut-out switch as claimed in claim 1, said auxiliary chambers are disposed in line with each other.

5. A high voltage cut-out switch as claimed in claim 1, wherein each auxiliary chamber is separated from the intermediate chamber by an insulative cone, said cone having an apex through which a connection is made between the end of the closing resistor and the stationary contact within said intermediate chamber.

6. A device according to claim 5, wherein said intermediate chamber and said auxiliary chambers carry dielectric fluid, and wherein the dielectric fluid of the intermediate chamber is different from that of the auxiliary chambers.

7. A device according to claim 5, further comprising an orifice disposed in the axis of the insulative cone for intercommunicating said intermediate chamber and the auxiliary chambers, and wherein said orifice carries a filter.

8. A high voltage cut-out switch as claimed in claim 3, wherein said stationary contacts and said moving contacts within the intermediate chamber and the separable fixed and movable main contacts of said main chambers are mounted so that the distance between the contacts of the intermediate chamber when open is shorter than that between the contacts of the main chambers.

9. A high voltage cut-out switch as claimed in claim 1, wherein said rod comprises a cam, said bridge comprises at least one spring biased stud riding on said rod and bearable on said cam, and said rod further comprises at least one stop for said spring biased stud to the side of said cam such that during initial movement of said rod in said given direction, said spring biased stud latches said bridge to said rod to cause said moving contacts to bridge said stationary contacts and to connect said resistors in series while further movement in said same direction causes said cam to force said spring biased stud against the bias to unlatch said bridge from said rod and to permit said moving bridge to move oppositely to said given direction of said rod and to open the connection between said resistors.

10. A high voltage cut-out switch as claimed in claim 1, wherein said moving bridge is slidably mounted on said rod, a compression spring means is coupled to said rod and said bridge and forms an over-center connection between said rod and said bridge, and said rod comprises upper and lower stops to control shifting of said bridge between over-center positions such that during initial movement of said rod in said given direction, said bridge moving contacts engage said stationary contacts for inserting said resistors in said circuit and during continued movement in said given direction said bridge moves away from said stationary contacts to re-open the circuit between said resistors.

11. The high voltage cut-out switch as claimed in claim 9, wherein said rod further comprises a second cam such that during rod movement in said given direction, said first cam contacts said stud to cause disconnection between said bridge and said rod, while during movement of said rod in the opposite direction, said second cam contacts the stud and moves said spring biased stud against its bias to effect relatching of said bridge to said rod to insure the desired sequence of operation in which said resistors are initially connected in series and shunted across the main contacts prior to closure of the main contacts, and said resistors are subsequently kept out of the circuit during opening of said main contacts.

12. A high voltage cut-out switch as claimed in claim 1, wherein said at least two series disposed main chambers comprise two pairs of series disposed main chambers, a rod is mounted for reciprocation and interposed between each of said series disposed main chambers of each pair, auxiliary insulative chambers extend parallel to the series disposed main chambers on opposite sides of the path of movement of said rod for each pair of series disposed main chambers, and wherein means are provided for effecting movement of both rods in said given direction such that the resistances in all four auxiliary chambers are initially connected in series and across the circuit by rod movement and the moving bridges carried thereby, subsequently closure of the contacts of one pair of main chambers is effected to shunt the closing resistors in two of the auxiliary chambers, the contacts of the second pair of main chambers are then closed to effect shunting of all resistors and during final movement of said rods in said given direction both bridges are moved away from their stationary contacts to open connections between closing resistors of the auxiliary chambers for respective pairs.

* * * * *